US007997109B2

(12) United States Patent
Flandrinck

(10) Patent No.: US 7,997,109 B2
(45) Date of Patent: Aug. 16, 2011

(54) DISENGAGEABLE LOCK FOR MOTOR VEHICLE LOCKING SYSTEM

(75) Inventor: Christian Flandrinck, Créteil (FR)

(73) Assignee: Valeo Securite Habitacle, Creteil Cedex (FR)

( * ) Notice: Subject to any disclaimer, the term of this patent is extended or adjusted under 35 U.S.C. 154(b) by 829 days.

(21) Appl. No.: 11/909,068

(22) PCT Filed: Mar. 15, 2006

(86) PCT No.: PCT/EP2006/060722
§ 371 (c)(1),
(2), (4) Date: Sep. 18, 2007

(87) PCT Pub. No.: WO2006/097476
PCT Pub. Date: Sep. 21, 2006

(65) Prior Publication Data

US 2008/0168810 A1 Jul. 17, 2008

(30) Foreign Application Priority Data

Mar. 18, 2005 (FR) ..... 05 02742

(51) Int. Cl.
*E05B 9/10* (2006.01)

(52) U.S. Cl. ..... 70/379 R; 70/419; 70/472

(58) Field of Classification Search ..... 70/379 R, 70/379 A, 380, 188–190, 222, 386, 422, 472, 70/419, DIG. 62, DIG. 42, 360
See application file for complete search history.

(56) References Cited

U.S. PATENT DOCUMENTS

| | | | | |
|---|---|---|---|---|
| 4,903,512 | A * | 2/1990 | Leroy et al. | 70/379 R |
| 5,044,183 | A * | 9/1991 | Neyret | 70/223 |
| 5,265,453 | A * | 11/1993 | Konii et al. | 70/379 R |
| 5,428,978 | A * | 7/1995 | Tsukano | 70/386 |
| 5,732,580 | A * | 3/1998 | Garnault et al. | 70/422 |
| 5,765,417 | A * | 6/1998 | Bolton | 70/495 |
| 6,021,654 | A * | 2/2000 | McCaa | 70/149 |
| 6,523,382 | B1 * | 2/2003 | Dimig et al. | 70/496 |
| 6,711,923 | B2 * | 3/2004 | Weyerstall | 70/379 R |
| 6,711,924 | B2 * | 3/2004 | Ritz | 70/422 |
| 6,978,645 | B2 * | 12/2005 | Shimon | 70/379 R |
| 2003/0230125 | A1 | 12/2003 | Ritz | |

FOREIGN PATENT DOCUMENTS

| | | |
|---|---|---|
| DE | 196 26 914 | 10/1997 |
| FR | 1 046 542 | 12/1953 |
| FR | 2 748 513 | 11/1997 |

OTHER PUBLICATIONS

International Search Report issued in PCT/EP2006/060722, mailed on Jul. 24, 2006, with translation (6 pages).

* cited by examiner

*Primary Examiner* — Kristina R Fulton
(74) *Attorney, Agent, or Firm* — Osha • Liang LLP

(57) ABSTRACT

A disengageable lock for a motor vehicle locking system includes a fixed stator, a sleeve, a rotor, a driver, and an indexer. The sleeve is mounted rotatably in the stator and is fixed axially relative to the stator. The rotor is mounted rotatably in the sleeve and is fixed axially in the sleeve. The driver is connected in disengageable rotation on the rotor. The indexer, which is axially mobile between rest and disengagement positions, is connected in translation in the stator by ribs surrounding the sleeve. When an appropriate key is inserted in the rotor, the driver couples the rotor and a cam actuator in rotation, releasing the lock. When an inappropriate key is inserted, the rotor and the sleeve rotate, causing the indexer to move toward the cam actuator. Because the indexer is rotationally immovable as a result of its connection with the stator, the cam actuator cannot rotate.

17 Claims, 4 Drawing Sheets

[Fig. 0001]
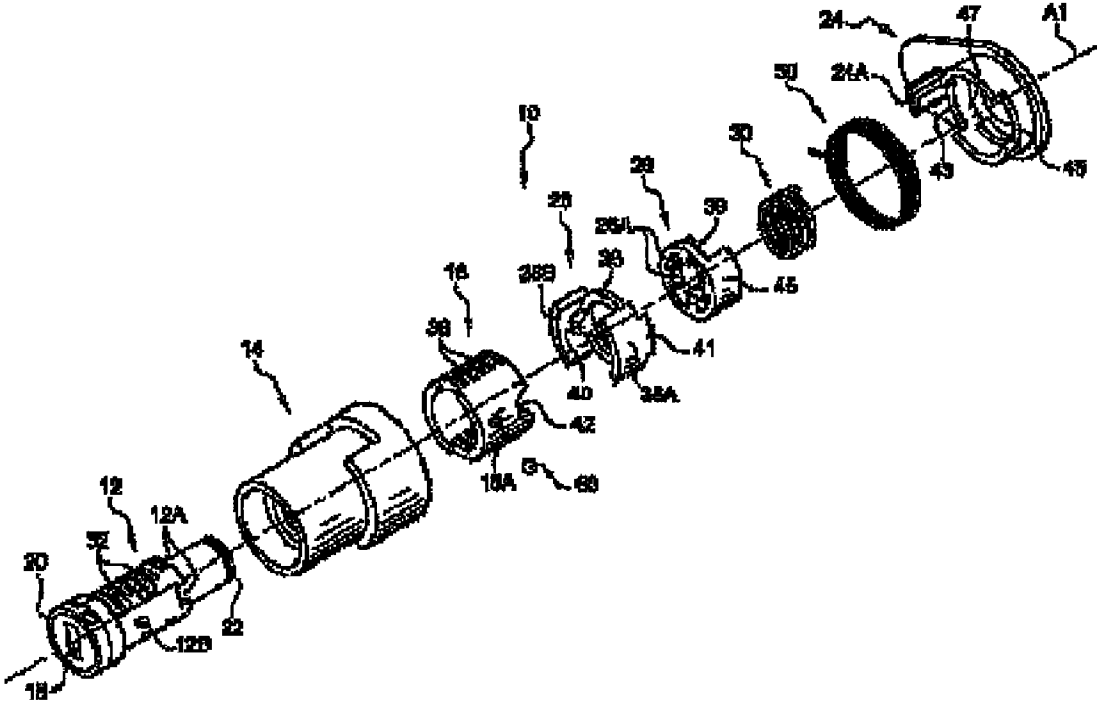
[Fig. 0002]
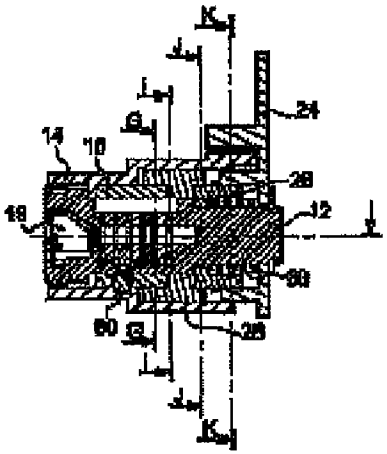

[Fig. 0003]
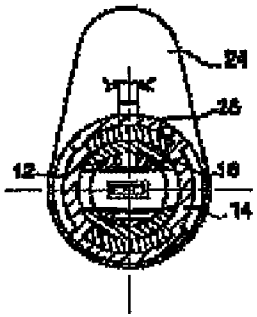
[Fig. 0004]
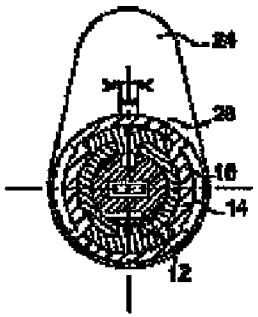
[Fig. 0005]
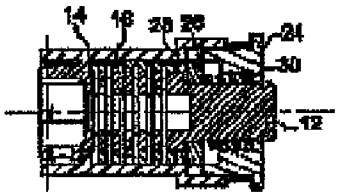
[Fig. 0006]
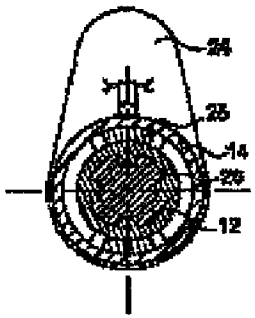

[Fig. 0007]
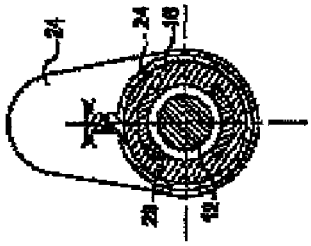
[Fig. 0008]
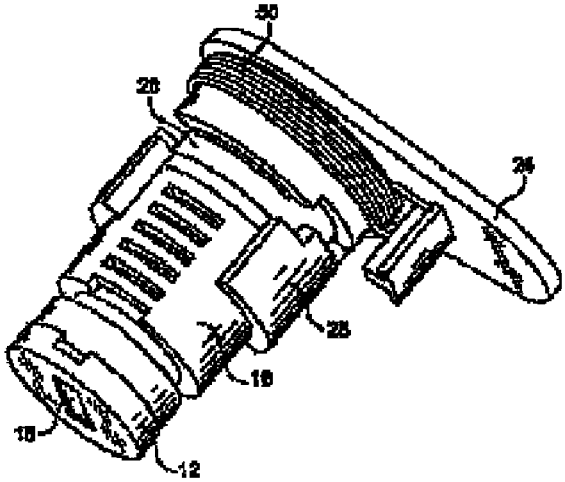
[Fig. 0009]
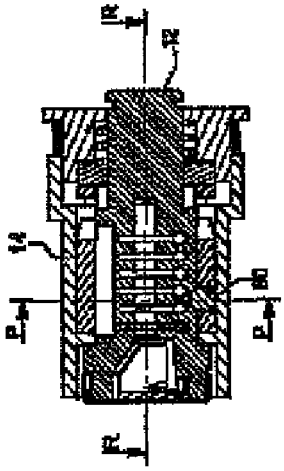

[Fig. 0010]
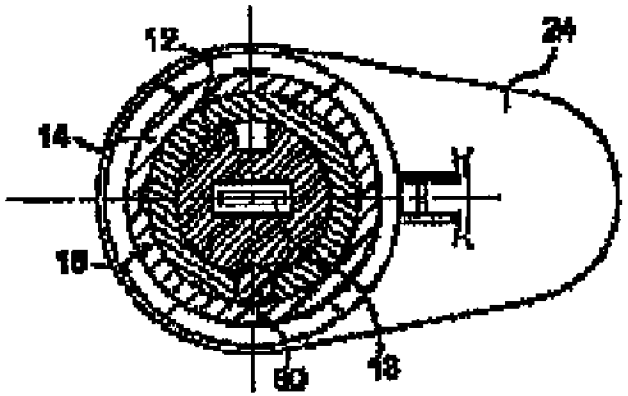
[Fig. 0011]
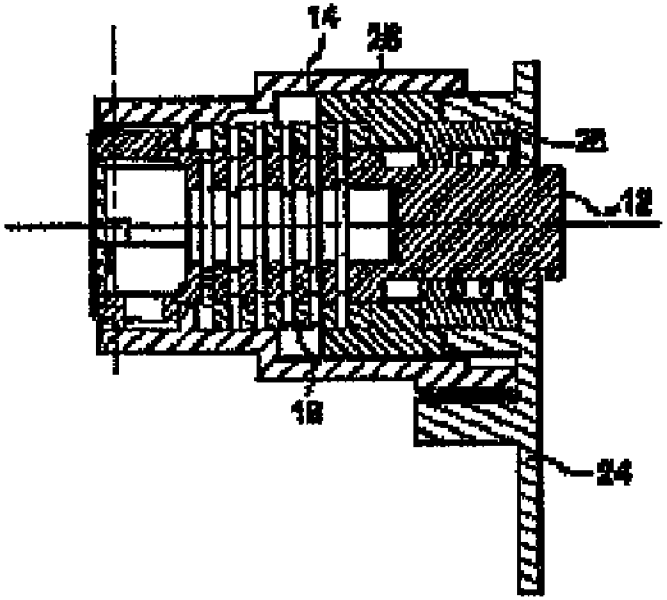

DISENGAGEABLE LOCK FOR MOTOR VEHICLE LOCKING SYSTEM

BACKGROUND OF THE INVENTION

The invention relates to a disengageable cylinder for an automobile lock mechanism.

The addition of a disengageable mechanism to a cylinder intended for an automobile lock makes it possible to prevent this cylinder from being forced. Specifically, if an improper key, or any other flat tool of suitable shape, is inserted into the rotor, and if an attempt is then made to rotate the rotor, the disengagement mechanism enables the rotor and an intermediate sleeve to pivot freely inside the stator without considerable stresses being exerted on the tumblers.

The fact is that, in the presence of excessive stresses, the tumblers are liable to be damaged or be retracted by force, thus allowing the cylinder to be unlocked without the appropriate key.

The invention is concerned more precisely with a disengageable cylinder, in particular for a motor vehicle lock mechanism, comprising a fixed stator, a tubular intermediate sleeve which is mounted in rotation about its axis in the stator and which is fixed axially with respect to the stator, a rotor which is mounted in rotation in the sleeve, which is fixed axially in the sleeve and which comprises tumblers which can move radially under the action of a key intended to be inserted axially into the rotor. Tumblers are fully retracted inside the rotor when the key is appropriate, so as to allow a free rotation of the rotor with respect to the sleeve and the stator and thus allow a lock operating lever, called a cam actuator, to be rotated, this lever being coupled to the rotor via a driver. The rotor and the intermediate sleeve are blocked against rotation with respect to one another by the tumblers when the key is not appropriate. The cylinder also comprises an indexer which can move axially between a rest position and a disengagement position, under the effect of a rotation of the sleeve with respect to the stator subsequent to the rotor being rotated by means of an inappropriate key, so as to move the driver axially toward a disengaged position.

Such a disengageable cylinder is described in patent document FR 2 748 513.

In this known cylinder, the indexer and the driver are in a configuration with a substantially end-to-end arrangement. These two parts are substantially arranged as a continuation of one another.

The indexer is coupled in rotation with the intermediate sleeve and is guided in translation therein. The driver for its part is guided in rotation on the rotor.

The indexer comprises a main ring and guide tabs which extend axially from the ring and which are intended to be accommodated in corresponding axial notches of the intermediate sleeve. It also comprises two lugs which extend axially in the opposite direction in the continuation of two diametrically opposed guide tabs.

This cylinder arrangement poses the following technical problems.

Due to its configuration with an end-to-end arrangement, the length of such a cylinder is relatively large.

Moreover, the indexer is a relatively fragile part due to its construction.

BRIEF SUMMARY OF THE INVENTION

The invention solves these problems by providing a disengageable cylinder which is particularly compact, that is to say one with a limited length and particularly robust construction.

Accordingly, the invention provides a disengageable cylinder, in particular for a motor vehicle lock mechanism, comprising a fixed stator, a tubular intermediate sleeve which is mounted in rotation about its axis in the stator and which is fixed axially with respect to the stator, a rotor which is mounted in rotation in the sleeve, which is fixed axially in the sleeve and which comprises tumblers which can move radially under the action of a key intended to be inserted axially into the rotor, the rotor and the intermediate sleeve being blocked against rotation with respect to one another by the tumblers when the key is not appropriate, a driver providing coupling between the rotor and an operating lever, called a cam actuator, when the key is appropriate, and an indexer which can move axially between a rest position and a disengagement position, under the effect of a rotation of the sleeve with respect to the stator subsequent to the rotor being rotated by means of an inappropriate key, so as to move the driver axially toward a disengaged position, characterized in that the indexer and the driver are cylindrical parts surrounding the rotor and can move while bearing on one another, in that the driver is connected in disengageable rotation on the rotor, and in that the indexer is connected in translation in the stator by means of ribs surrounding the intermediate sleeve.

According to a preferred embodiment, the driver is uncoupled from the rotor, in said disengaged position.

Preferably, the driver comprises internal ribs inserted in corresponding grooves of the rotor, in the engaged position, these grooves being open toward the rear of the rotor over a cylindrical portion whose diameter is less than the internal diameter of the driver.

Advantageously, the cylinder comprises a compression spring interposed between the cam actuator and the driver.

Preferably, the driver comprises, on its edge facing the cam actuator, at least one guide tab intended to cooperate with a corresponding notch belonging to the cam actuator, this notch allowing a translation of the driver toward the cam actuator against the force of the compression spring.

Said notch may be open on the rear end face of the cam actuator.

The driver may comprise a collar and two guide lugs which extend axially toward the cam actuator from the collar.

Preferably, the indexer is coupled in rotation with the cam actuator, in said disengaged position.

Advantageously, the indexer comprises, on its edge facing the cam actuator, at least one guide tab intended to cooperate with a corresponding notch belonging to the cam actuator.

Preferably, the indexer comprises, on its edge facing the key entry, at least one guide tab intended to cooperate with a corresponding notch belonging to the intermediate sleeve.

Advantageously, the indexer comprises a main ring, two first guide tabs of trapezoidal shape, as seen in cross section through a plane tangential to the ring, which extend axially toward the key entry from the ring, and two second guide tabs which extend axially toward the cam actuator from the ring.

The intermediate sleeve may comprise two notches corresponding to said first guide tabs, and the cam actuator comprises two notches corresponding to said second guide tabs.

The invention is described in more detail below with the aid of figures representing only one preferred embodiment of the invention.

BRIEF DESCRIPTION OF THE DRAWINGS

FIG. 1 is an exploded perspective view of a disengageable cylinder according to the invention.

FIG. 2 is a view in longitudinal section of the disengageable cylinder according to the invention, in the initial position.

FIG. 3 is a view in cross section on G in FIG. 2.

FIG. 4 is a view in cross section on I in FIG. 2.

FIG. 5 is a view in longitudinal section on C in FIG. 2.

FIG. 6 is a view in cross section on J in FIG. 2.

FIG. 7 is a view in cross section on K in FIG. 2.

FIG. 8 is a perspective view of a cylinder according to the invention, in the engaged position, the stator not being represented.

FIG. 9 is a view in longitudinal section of the disengageable cylinder according to the invention, in the disengaged position.

FIG. 10 is a view in cross section on P in FIG. 9.

FIG. 11 is a view in longitudinal section on R in FIG. 9.

DETAILED DESCRIPTION OF THE INVENTION

FIG. 1 shows a rotary cylinder of longitudinal axis A1 that comprises disengagement means according to the teachings of the invention. This cylinder is represented in FIGS. 2 to 7 in the initial position before insertion of a key.

The cylinder 10 essentially comprises a rotor 12 which is rotatably mounted, about the axis A1, inside a fixed stator 14, with a tubular intermediate sleeve 16 being interposed between the two of them, this sleeve being mounted in rotation about its axis in the stator and being fixed axially with respect to the stator.

A ball 60 is mounted intermediately in a radial through orifice 16A formed in the intermediate sleeve 16. The rotor 12, on the one hand, has an external cavity 12R for accommodating this ball, and the stator 14, on the other hand, has an internal cavity (not shown) for accommodating this ball. This orifice 16A, this cavity 12B in the rotor and this cavity 14B in the stator are arranged such that in the rest position, before rotation of a key, the orifice 16A, the cavity 12B in the rotor and the internal cavity in the stator are aligned as represented in FIG. 2.

The rotor 12 is intended to be rotated by means of a key (not shown) inserted axially inside the rotor 12 through a key entry 18 arranged in a front transverse face 20 of the rotor 12, which face 20 is intended, for example, to be flush with the outside of a vehicle body panel (not shown).

The rear axial end 22 of the rotor 12 is intended to rotate a lever 24 which operates a lock mechanism (not shown) so as to allow the locking and unlocking of an opening leaf of the vehicle.

The rotor 12 is able to rotate the operating lever 24, only in the presence of an appropriate key, via a driver 26 which can move axially in the cylinder 10, under the action of an indexer 28, between an engaged position in which it connects the rotor 12 and the operating lever 24 in rotation, and a disengaged position in which the rotor 12 is no longer able to rotate the lever 24 and in which the indexer 28 ensures that the lever 24 is blocked against rotation with respect to the stator 14 of the cylinder 10.

The rotor 12, the stator 14 and the intermediate sleeve 16 are not able to move in translation along the axis A1 with respect to one another, and a helical compression spring 30 is interposed between the cam actuator 24 and the driver 26 so as to urge the latter axially rearward toward its engaged position.

The stator 14 has a cylindrical tubular general shape and it comprises means (not shown) which allow the cylinder 10 to be mounted and fastened on the vehicle.

In a known manner, the rotor 12 is intended to receive tumblers 32 arranged in transverse planes which follow one another at regular intervals in the direction of the axis A1 of the cylinder 10, these tumblers being received in corresponding housings of the rotor 12.

The tumblers 32 can move radially in the rotor 12 and they are urged elastically toward a projecting position in which they partially protrude outside the housings of the rotor 12.

However, when an appropriate key is inserted inside the rotor 12, the tumblers 32 are fully retracted radially inward into the rotor 12.

Thus, when the appropriate key is inserted into the rotor 12, the latter can pivot freely with respect to the cylindrical intermediate sleeve 16 and with respect to the stator 14.

However, if an inappropriate key, or any other tool, is inserted into the rotor 12, the tumblers 34 are not fully retracted and are received inside corresponding apertures 36 arranged in the intermediate sleeve 16. Thus, the tumblers 34 immobilize the rotor 12 in rotation with respect to the intermediate sleeve 16 which, for its part, remains free to rotate with respect to the stator 14.

The indexer 28, which can move axially between a rest position and a disengagement position, is connected in translation on the stator 14 via grooves arranged inside the stator and via ribs 38A, 38B which slide inside these grooves and surround the intermediate sleeve 16. The ribs 38A, 38B and the grooves are two in number and are diametrically opposed.

The indexer 28 particularly comprises a main ring 38 and first guide tabs 40 of trapezoidal shape, as seen in cross section through a plane tangential to the ring 38, which extend axially toward the front from the ring 38. These first tabs 40 are intended to be received in corresponding axial notches 42 of the intermediate sleeve 16. These first guide tabs 40 are two in number and are diametrically opposed on the ring 38.

The notches 42 open out axially toward the rear in the rear axial end of the sleeve 16 such that, together with the guide tabs 40, they make it possible to rotationally connect the indexer 28 with the intermediate sleeve 16, while still allowing the possibility for the indexer 28 to move axially in the cylinder 10.

The indexer also comprises second guide tabs 41 of rectangular shape, as seen in cross section through a plane tangential to the ring 38, which extend axially toward the rear from the ring 38. These second tabs 41 are intended to be received in corresponding axial notches 43 of the cam actuator 24. These second guide tabs 41 are two in number, are diametrically opposed on the ring 38 and are arranged substantially opposite the first guide tabs 40.

The driver 26 provides coupling between the rotor 12 and the cam actuator 24 when the key is appropriate. It is connected in translation on the rotor via internal ribs 26A and via grooves 12A belonging to the rotor 12.

The internal ribs 26A are inserted in the corresponding grooves 12A of the rotor, in the engaged position, these grooves being open toward the rear of the rotor 12 over a cylindrical portion whose diameter is less than the internal diameter of the driver.

The driver 26 comprises a collar 39 whose outside or inside diameter is substantially equal to the outside or inside diameter of the ring 38 of the indexer 28, the indexer and the driver being arranged end to end.

The driver 26 comprises guide lugs 45 of rectangular shape, as seen in cross section through a plane tangential to the collar 39, which extend axially toward the rear from the collar 39. These guide lugs 45 are intended to be received in corresponding axial notches 47 of the cam actuator 24, these notches allowing a translation of the driver toward the cam actuator against the force of the compression spring 30 and advantageously being open on the rear end face of the cam actuator. These guide lugs 45 are two in number and are diametrically opposed on the collar 39.

The cylinder 10 also comprises a return spring 50 which operates in torsion and which serves to return the cam actuator 24 to the initial position.

The operation of the cylinder according to the invention will now be described with reference to the other figures.

In FIG. 8, an appropriate key has been inserted into the rotor 12 through the key entry 18, and the cylinder is thus in the engaged position. The tumblers 32 are thus retracted inside the rotor 12, which can turn in the intermediate sleeve 16.

In this position, the rotor 12 can be turned with the key and drives the driver 26 along with it, this driver, by virtue of its lugs 45 fitting into the corresponding notches 47 of the cam actuator 24, causing said actuator to rotate, releasing the lock.

The other parts remain immovable, more precisely the intermediate sleeve 16, which is rotationally immovable and connected to the stator 14 by the ball 60, and the indexer 28 fitted into said sleeve by its front guide tabs 40.

The rotation of the cam actuator 24 is obtained by the rotation of the following parts: key/rotor/driver/cam actuator.

At the end of travel, when the key is released, the return spring 50, whose one end is fixed and other end butts against a lug 24A of the cam actuator 24, returns the cam actuator to the initial position along with the driver and the rotor.

In FIGS. 9 to 11, an inappropriate key has been inserted into the rotor 12 through the key entry 18, and the cylinder is thus in the disengaged position. The tumblers 32 are thus not retracted inside the rotor 12, which is consequently rotationally connected to the intermediate sleeve 16 as a result of the tumblers being inserted in the latter.

The rotation of the inappropriate key thus causes the rotor 12 and intermediate sleeve 16, which are interconnected and take along the ball 60 in the orifice 16A of the intermediate sleeve 16 and in the cavity 12B in the rotor 12, to be rotated. The rotation of the sleeve 16 results in the translation of the indexer 28 in the direction of the cam actuator 24 by virtue of the front guide tabs 40 of the indexer sliding out of the corresponding notches 42 of the sleeve 16. In this translated position, the rear guide tabs 41 of the indexer 28 become inserted in the corresponding notches 43 of the cam actuator 24. Since the indexer 28 is rotationally immovable as a result of its connection with the stator, the cam actuator cannot turn.

The driver 26 for its part is uncoupled from the rotor 12, since it is pushed against the force of the compression spring 30 by the indexer 28 which bears on the front end face. Its ribs 26A thus leave the corresponding notches 12A of the rotor, and the rotational connection of the rotor and the driver is broken.

In this disengaged position, during the rotation of an inappropriate key, the ball rotationally connects the intermediate sleeve 16 and the rotor 12, that is to say is inserted in the external cavity 12B in the rotor.

The deliberate rotation of the key thus results in the movement of the following parts: rotation of the rotor/rotation of the intermediate sleeve/translation of the indexer and blocking of the cam actuator against rotation/rotation of the driver and uncoupling of the cam actuator.

During the subsequent insertion of an appropriate key, the rotor 12 is turned by virtue of the rotation of the key to the initial position represented in FIGS. 2 to 7, the ball 60 being released from the rotor, and then the cylinder is engaged if the key is appropriate or is disengaged if the key is inappropriate.

The invention claimed is:

1. A disengageable cylinder for a motor vehicle lock mechanism, comprising:

a fixed stator;

a tubular intermediate sleeve which is mounted in rotation about its axis in the stator and which is fixed axially with respect to the stator;

a rotor which is mounted in rotation in the sleeve, which is fixed axially in the sleeve and which comprises tumblers which can move radially under the action of a key intended to be inserted axially into the rotor, the rotor and the intermediate sleeve being blocked against rotation with respect to one another by the tumblers when the key is not appropriate, a driver providing a coupling between the rotor and a cam actuator, when the key is appropriate; and an indexer which can move axially between a rest position and a disengagement position, under the effect of a rotation of the sleeve with respect to the stator subsequent to the rotor being rotated by means of an inappropriate key, so as to move the driver axially toward a disengaged position, wherein the indexer and the driver are cylindrical parts surrounding the rotor and can move while bearing on one another, wherein the driver is connected in disengageable rotation on the rotor, wherein the indexer is connected in translation in the stator by means of ribs surrounding the intermediate sleeve, and wherein the indexer, which is rotationally immovable, is coupled in rotation with the cam actuator in said disengaged position, thereby blocking the cam actuator from rotation in said disengaged position.

2. The cylinder claimed in claim 1, wherein the driver is uncoupled from the rotor, in said disengaged position.

3. The cylinder as claimed in claim 2, wherein the driver comprises internal ribs inserted in corresponding grooves of the rotor, in the engaged position, these grooves being open toward the rear of the rotor over a cylindrical portion whose diameter is less than the internal diameter of the driver.

4. The cylinder as claimed in claim 3, wherein the cylinder comprises a compression spring interposed between the cam actuator and the driver.

5. The cylinder as claimed in claim 4, wherein the driver comprises, on an edge facing the cam actuator, at least one guide lug intended to cooperate with a corresponding notch belonging to the cam actuator, this notch allowing a translation of the driver toward the cam actuator against the force of the compression spring.

6. The cylinder as claimed in claim 5, wherein said notch is open on the rear end face of the cam actuator.

7. The cylinder as claimed in claim 6, wherein the driver comprises a collar and two guide lugs which extend axially toward the cam actuator from the collar.

8. The cylinder as claimed in claim 1, wherein the indexer comprises, on an edge facing the cam actuator, at least one guide tab intended to cooperate with a corresponding notch belonging to the cam actuator.

9. The cylinder as claimed in claim 8, wherein the indexer comprises, on an edge facing a key entry, at least one guide tab intended to cooperate with a corresponding notch belonging to the intermediate sleeve.

10. The cylinder as claimed in claim 9, wherein the indexer comprises a main ring, two first guide tabs of trapezoidal shape, as seen in cross section through a plane tangential to the ring, which extend axially toward the key entry from the ring, and two second guide tabs which extend axially toward the cam actuator from the ring.

11. The cylinder as claimed in claim 10, wherein the intermediate sleeve comprises two notches corresponding to said first guide tabs, and the cam actuator comprises two notches corresponding to said second guide tabs.

12. The cylinder as claimed in claim 2, wherein the indexer is coupled in rotation with the cam actuator, in said disengaged position.

13. The cylinder as claimed in claim 3, wherein the indexer is coupled in rotation with the cam actuator, in said disengaged position.

14. The cylinder as claimed in claim 4, wherein the indexer is coupled in rotation with the cam actuator, in said disengaged position.

15. The cylinder as claimed in claim 5, wherein the indexer is coupled in rotation with the cam actuator, in said disengaged position.

16. The cylinder as claimed in claim 6, wherein the indexer is coupled in rotation with the cam actuator, in said disengaged position.

17. The cylinder as claimed in claim 7, wherein the indexer is coupled in rotation with the cam actuator, in said disengaged position.

* * * * *